US007861989B2

(12) United States Patent
Cross

(10) Patent No.: US 7,861,989 B2
(45) Date of Patent: Jan. 4, 2011

(54) DRAPERY ROD BRACKET

(75) Inventor: Brandon Seth Cross, Charlotte, NC (US)

(73) Assignee: Newell Window Furnishings, Inc., High Point, NC (US)

( * ) Notice: Subject to any disclaimer, the term of this patent is extended or adjusted under 35 U.S.C. 154(b) by 0 days.

(21) Appl. No.: 12/504,258

(22) Filed: Jul. 16, 2009

(65) Prior Publication Data

US 2009/0272864 A1 Nov. 5, 2009

Related U.S. Application Data

(63) Continuation of application No. 11/550,083, filed on Oct. 17, 2006, now abandoned.

(51) Int. Cl.
*A47H 1/10* (2006.01)

(52) U.S. Cl. ..... 248/261; 248/250; 248/254; 160/38; 160/39

(58) Field of Classification Search ..... 248/250, 248/251, 261, 254, 262, 268, 267, 269, 257, 248/534, 65, 259, 260, 266, 265, 256, 258, 248/253; 16/87.2; 211/123, 124, 105.1, 211/105.3, 105.5, 105.6; 160/38, 39, 126
See application file for complete search history.

(56) References Cited

U.S. PATENT DOCUMENTS

| | | | | | |
|---|---|---|---|---|---|
| 271,446 | A * | 1/1883 | Gibbs | ..... | 248/265 |
| 640,993 | A * | 1/1900 | Clark | ..... | 248/262 |
| 937,457 | A * | 10/1909 | Moffat | ..... | 248/263 |
| 983,692 | A * | 2/1911 | Deucker | ..... | 248/263 |
| 1,203,765 | A * | 11/1916 | Miller | ..... | 248/263 |
| 1,373,333 | A * | 3/1921 | Kennedy et al. | ..... | 248/256 |
| 1,869,281 | A * | 7/1932 | Herman et al. | ..... | 248/263 |
| 3,889,912 | A * | 6/1975 | Ray | ..... | 248/255 |
| 4,120,474 | A * | 10/1978 | Hurley | ..... | 248/263 |
| 4,140,294 | A * | 2/1979 | Zwarts | ..... | 248/265 |
| 4,283,035 | A * | 8/1981 | Ojembarrena et al. | ..... | 248/263 |
| 5,544,393 | A * | 8/1996 | Lightfoot | ..... | 24/306 |
| 6,135,403 | A * | 10/2000 | Goldstein | ..... | 248/253 |
| 7,028,960 | B2 * | 4/2006 | Goldstein | ..... | 248/263 |
| 7,096,560 | B2 * | 8/2006 | Oddsen, Jr. | ..... | 29/525.11 |

* cited by examiner

*Primary Examiner*—Kimberly T Wood
(74) *Attorney, Agent, or Firm*—Dennis J. Williamson; Moore & Van Allen, PLLC

(57) ABSTRACT

The bracket comprises a support arm that can be mounted to either a vertical surface such as a wall or a horizontal surface such as a ceiling. A rod supporting member such as a ring or hook is removably attached to the arm and is adapted to receive and support a drapery rod. The rod supporting member can be removed from the support arm and attached directly to a surface to provide an inside mount for the rod. A separate mounting clip may be used to mount the rod supporting member to the surface. the mounting clip may be provided with a rod engaging element for centering the rod and a surface engaging element for fixing the position of the rod supporting member on the surface.

6 Claims, 11 Drawing Sheets

DRAPERY ROD BRACKET

CROSS REFERENCE TO RELATED APPLICATIONS

This is a continuation of the U.S. patent application Ser. No. 11/550,083 for "Drapery Rod Bracket" filed on Oct. 17, 2006, which is incorporated by reference in its entirety.

The invention relates generally to window coverings such as draperies and more particularly to an improved bracket for a drapery rod.

BACKGROUND OF THE INVENTION

In a typical drapery rod installation the drapery rod consists of an elongated substantially cylindrical pole that is supported at or near its ends by brackets. Depending upon the type of drapery, the desired aesthetic look, the structure to which the rod is to be mounted, and other factors, different types of brackets are used to mount the rod in different installations. For example, the brackets may be mounted to a vertical surface such as a wall (wall mount), to a horizontal surface such as a ceiling (ceiling mount) or to the inside of a surface such as a window casement (inside mount) where each mounting arrangement requires a different type of bracket having a structure particularly suited for the type of installation.

The necessity of providing different mounting brackets can make the sale and installation of drapery rods unduly complicated and expensive. Manufacturers and retailers are required to stock different types of brackets and customers are required to purchase the type of bracket particularly suited for the type of installation. For do-it-yourself installations, the customer often is uncertain of the type of bracket that is required for the particular installation at the time of purchase leading to frustration and wasted time and effort. Moreover, drapery rods and brackets may be sold as kits where the rod and brackets are sold together complicating both the purchase decision of the customer and inventory and supply issues for the manufacturer and retailer.

Thus an improved drapery rod bracket is desired.

SUMMARY OF THE INVENTION

The bracket of the invention comprises an adjustable support arm that can be mounted to either a vertical surface such as a wall or a horizontal surface such as a ceiling. A rod supporting member such as a ring or hook is removably attached to the arm and is adapted to receive and support the drapery rod. The rod supporting member can be removed from the support arm and attached directly to a surface to provide an inside mount for the rod. A separate mounting clip may be used to mount the rod supporting member to the surface. The mounting clip may be provided with a rod engaging element for centering the rod and a surface engaging element for fixing the position of the rod supporting member on the surface. A rod may be supported by the bracket in the wall mount, ceiling mount and/or inside mount positions.

DETAILED DESCRIPTION OF EMBODIMENTS OF THE INVENTION

Figure 1:
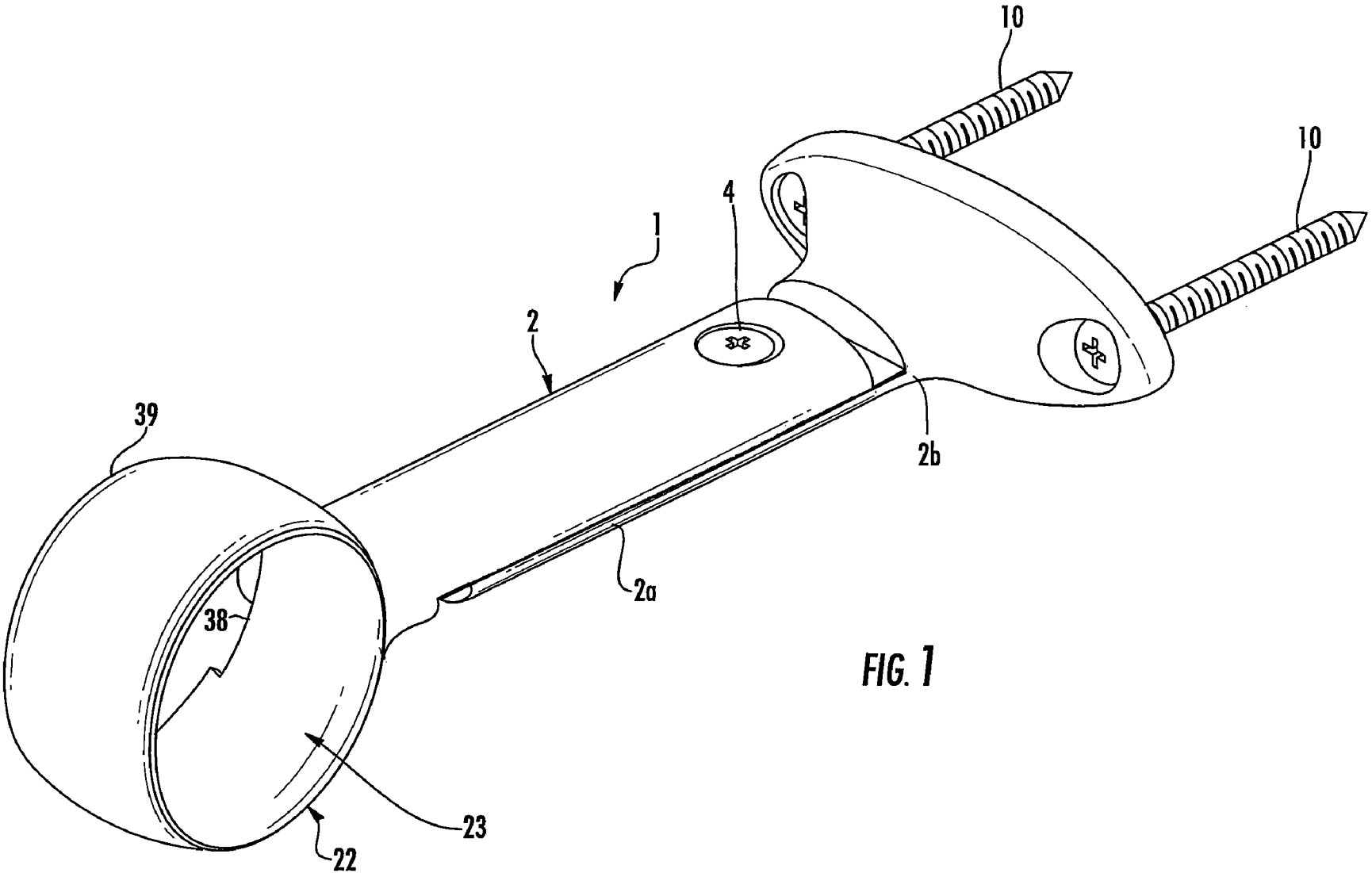
FIG. 1 is a perspective view of the bracket of the invention.
Figure 2:
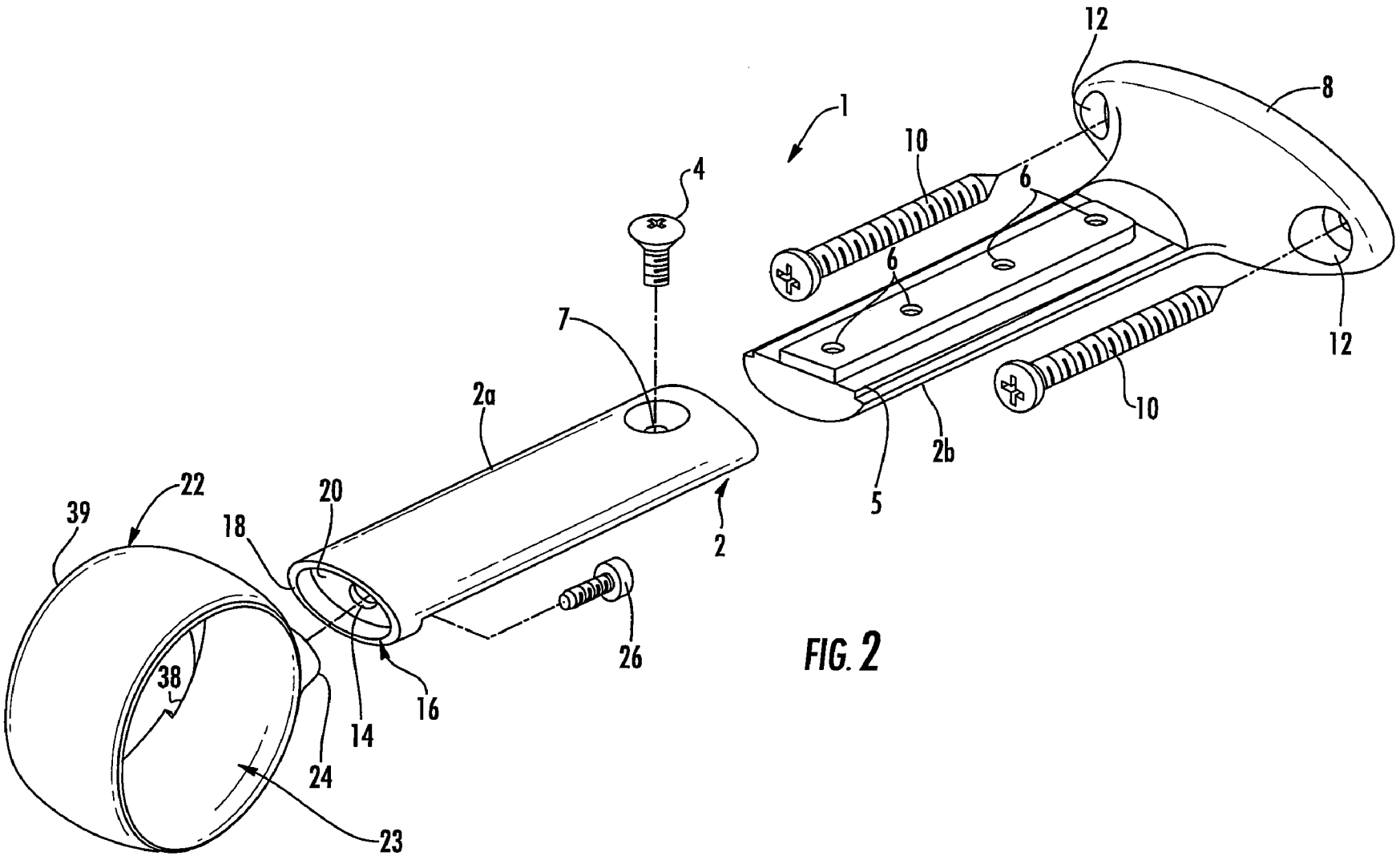
FIG. 2 is a perspective view of the bracket of the invention with the components in a disassembled condition.

The bracket of the invention is shown generally at 1 in FIGS. 1 and 2 and comprises an adjustable support arm 2. Arm 2 has a first arm portion 2*a* and a second arm portion 2*b* where arm portion 2*a* can slide relative to arm portion 2*b* to adjust the length of the arm 2. Arm portion 2*b* is formed with a mounting flange 8 where flange 8 includes holes 12 for receiving screws or other fasteners 10. The fasteners 10 are inserted through the holes 12 and are secured to a surface such as a wall or ceiling to mount the arm to the surface. Mounting flange 8 may be made integrally with arm portion 2*b* or it may be a separate component attached thereto.

Figure 6:
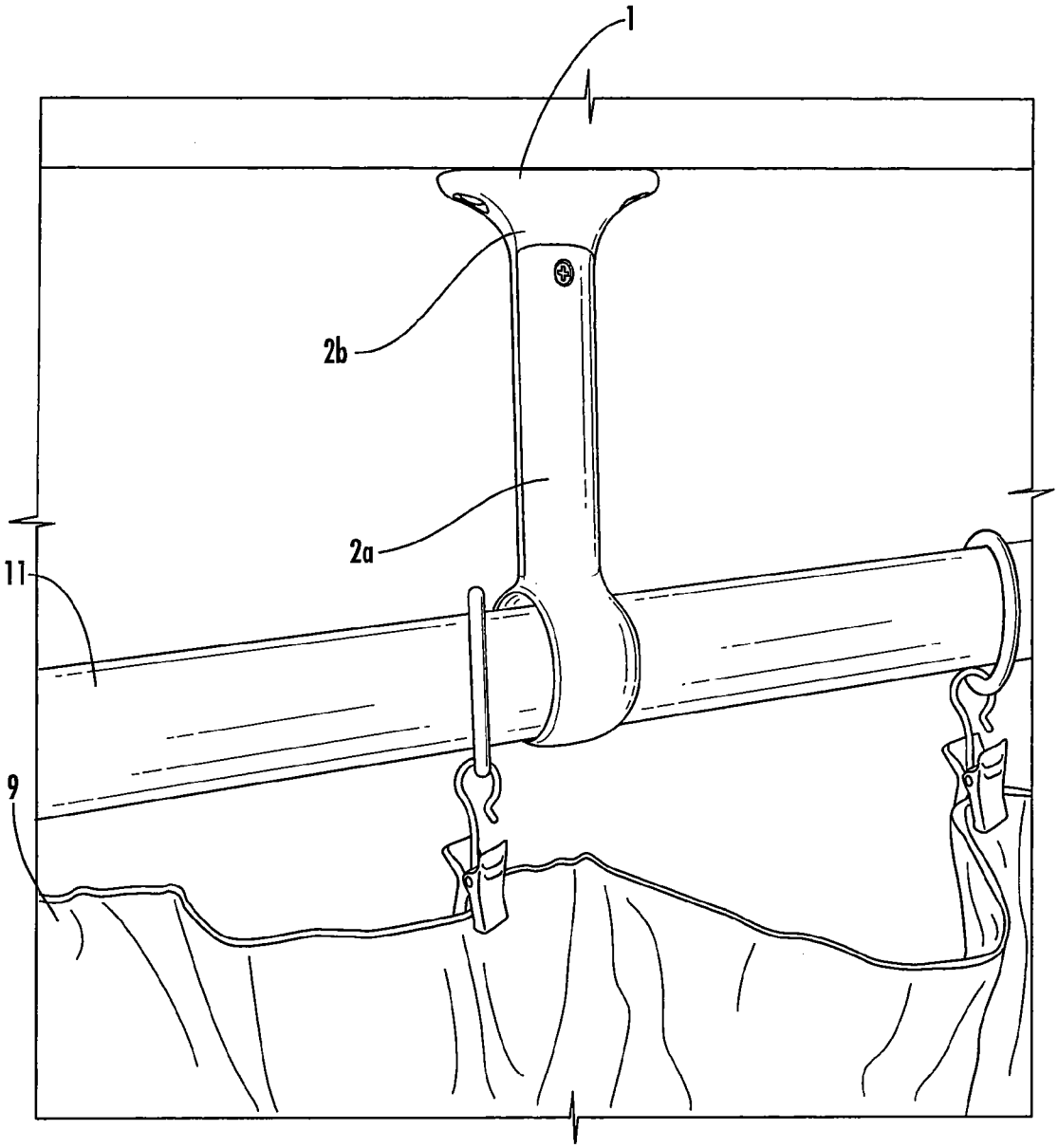
FIG. 6 shows the bracket of the invention used as a ceiling mount.

Arm portions 2*a* and 2*b* are formed with mating tracks 5 that allow the arms to reciprocate relative to one another in a telescoping manner to adjust the length of arm 2. Arm portion 2*a* is formed with a through hole 7 for receiving a fastener 4 such as a threaded screw. Arm portion 2*b* is formed with a plurality threaded holes 6 that can be selectively engaged by fastener 4 such that arm portion 2*a* can be fixed in position relative to arm portion 2*b*. The use of discrete threaded holes 6 rather than continuously adjustable members enables the bracket 1 to be used as a ceiling mount bracket as shown in FIG. 6. When a bracket is mounted to a ceiling or other horizontal surface the weight of the rod 11 and drapery 9 will tend to pull arm portion 2*a* from arm portion 2*b*. If continuously adjustable members are used to provide the adjustment where friction is relied on to fix the relative positions of the arm portions, the weight of the rod and drapery on the arm 2 may eventually cause the arm portions to slip relative one another and expand the bracket. Using the discrete adjustment where the fastener 4 mechanically engages one of the threaded holes 6, the position of the arm portions is fixed and the weight of the rod 11 and draperies 9 is supported.

A hole 14 is formed in face 16 arranged at the end of arm portion 2*a*. In the illustrated embodiment surface 16 is bounded by a wall 18 to create a recessed area 20 that receives a mating protrusion 24 formed on rod supporting member 22. Rod supporting member 22 defines an interior space 23 in which the rod is located. In FIGS. 1 through 9 and 11 the rod supporting member 22 is a ring that surrounds the rod and in FIG. 10 the rod supporting member 58 is a hook that partially surrounds the rod. Other constructions of the rod supporting member are possible. Protrusion 24 has a threaded hole 25 (FIG. 3) that is arranged coaxially with hole 14. A threaded fastener 26 such as a screw is inserted through hole 14 and into threaded hole 25 to releasably secure the rod supporting member 22 to the arm 2. While a separate fastener is shown it is to be understood that either rod supporting member 22 or arm 2 may be provided with an integral fastener.

To mount the bracket as either a ceiling mount (FIG. 6) or a wall mount (FIG. 7), the assembly shown in FIGS. 1 and 2 is used. The arm 2 is secured to the surface using fasteners 10 in either a vertical orientation (ceiling mount) or a horizontal orientation (wall mount). Arm portion 2*a* can be adjusted relative to arm portion 2*b* to create an arm 2 of the desired length. The mechanical engagement of fastener 4 with discrete mating receptacles 6 fixes the arm portions 2*a* and 2*b* relative to one another in both a wall mount installation and a ceiling mount installation.

Figure 3:
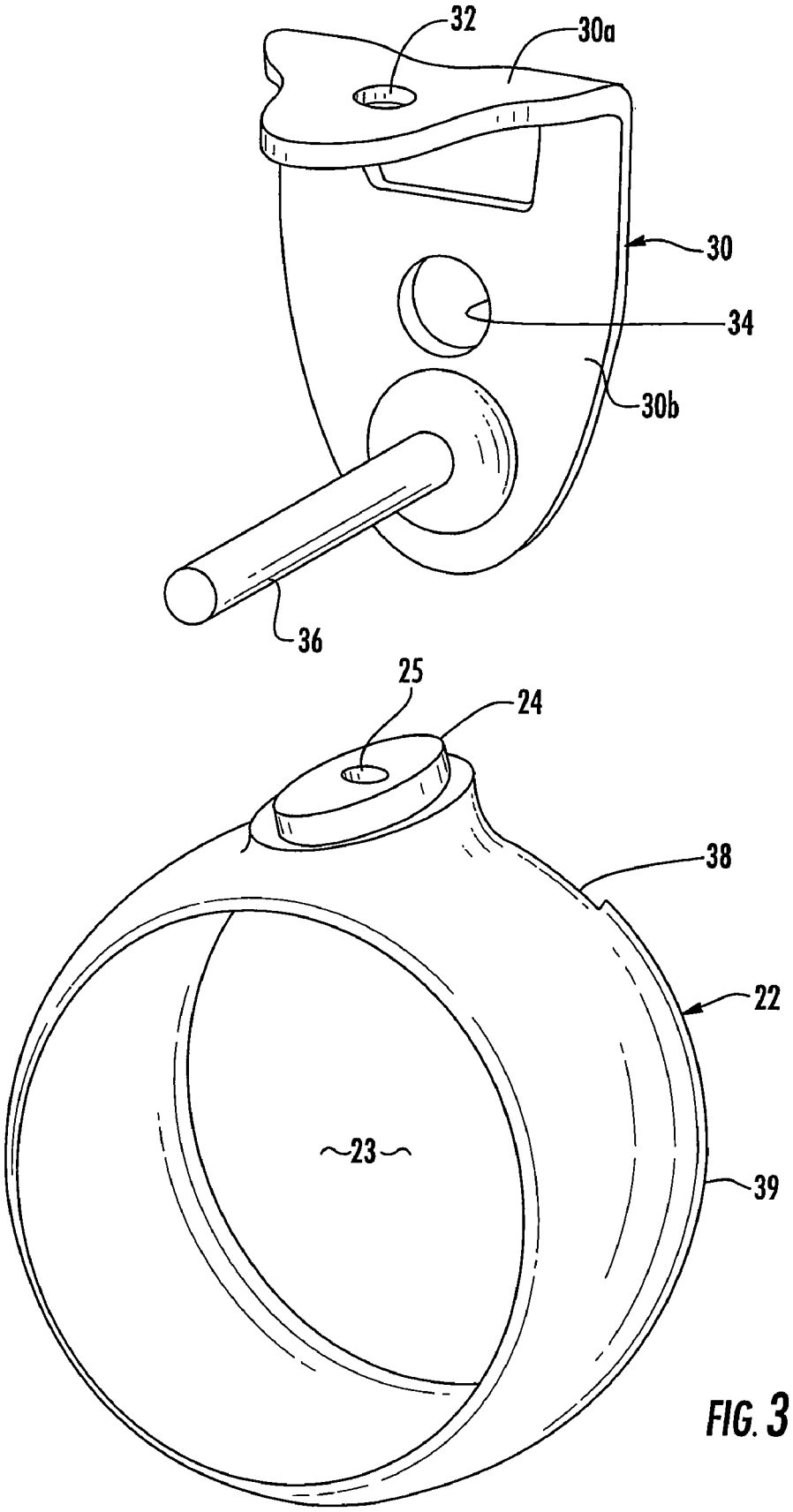
FIG. 3 is a perspective view of the rod supporting member and separate mounting clip in a disassembled condition.
Figure 4:
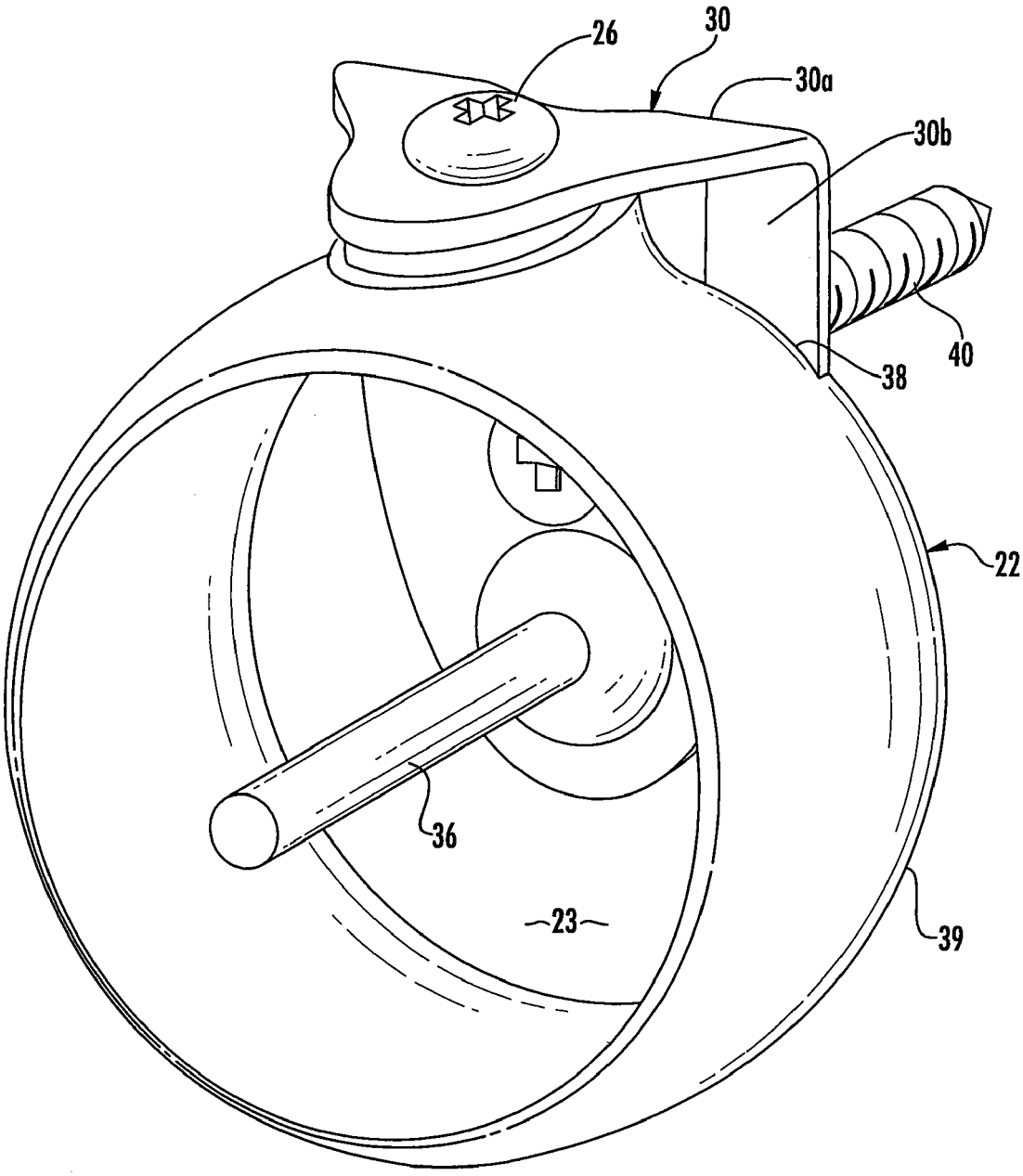
FIG. 4 is a perspective view of the rod supporting member and separate mounting clip in an assembled condition.
Figure 5:
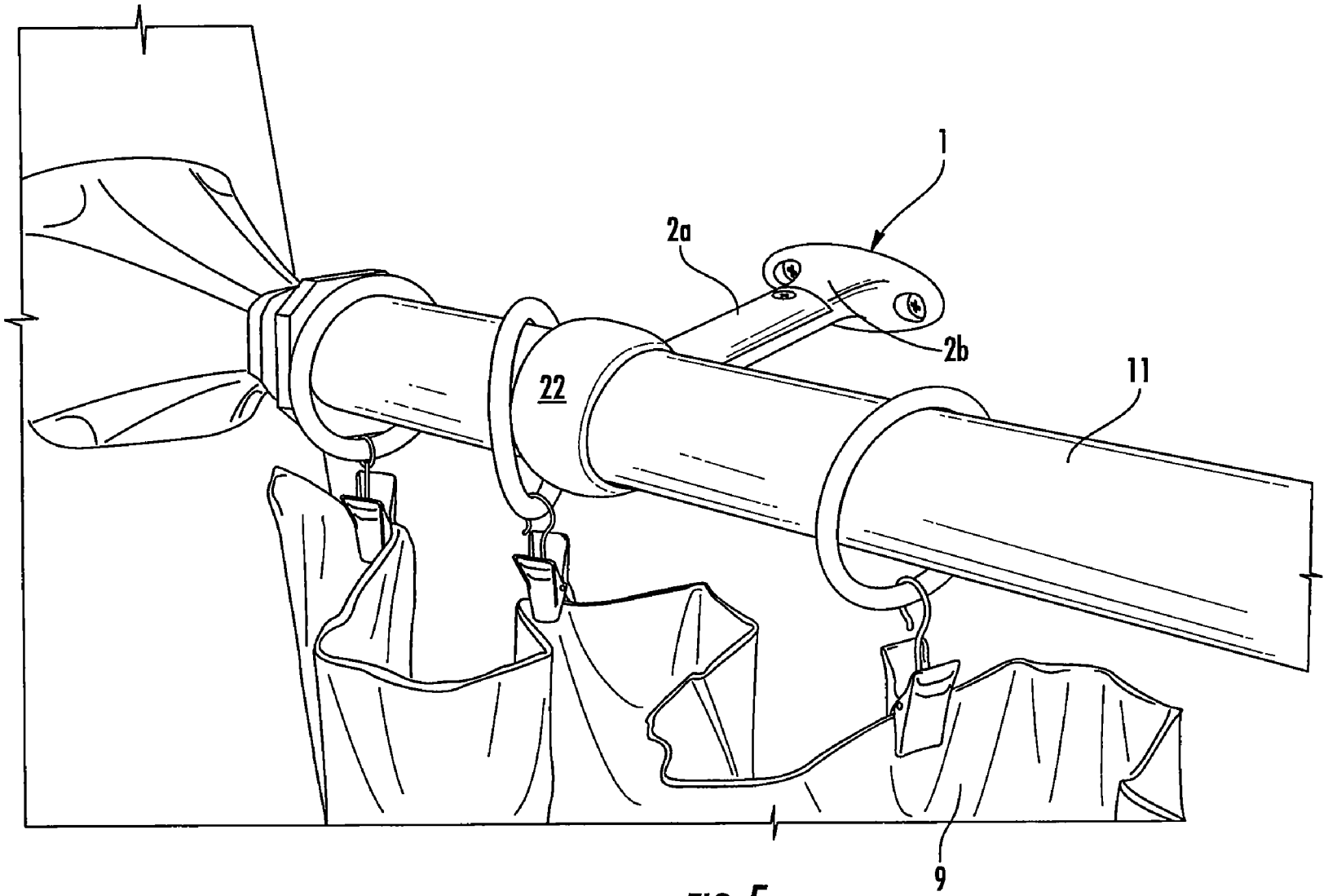
FIG. 5 shows the bracket of the invention used as a wall mount.
Figure 7:
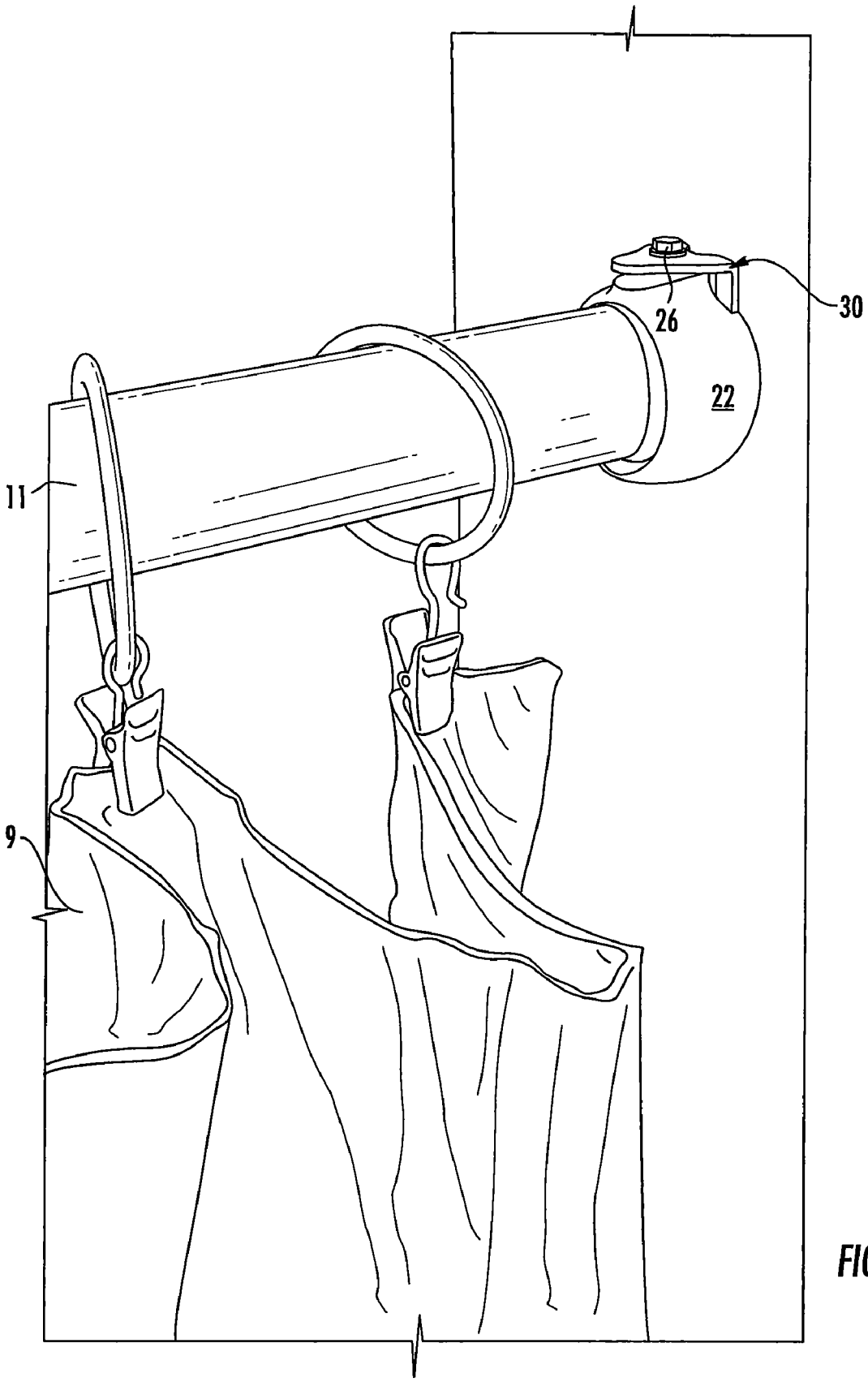
FIG. 7 shows the bracket of the invention used as an inside mount.
Figure 8:
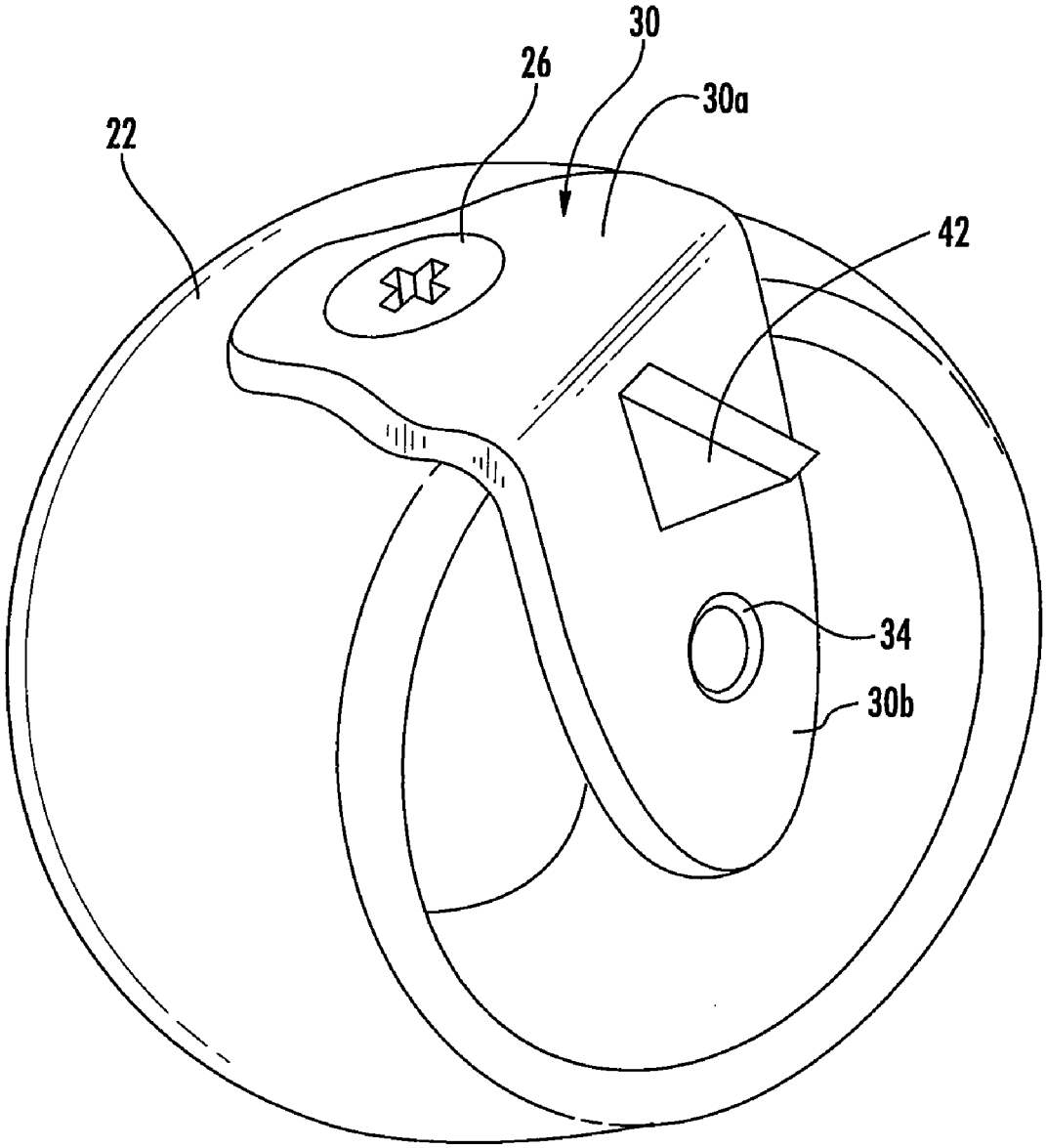
FIG. 8 is a rear perspective view of the rod supporting member and mounting clip.

To use the bracket of the invention as an inside mount, the rod supporting member 22 is removed from arm 2 by unfastening fastener 26. Referring to FIGS. 3, 4 and 7 a mounting clip 30 is attached to rod supporting member 22 using fastener 26. In the embodiment illustrated in FIGS. 1 and 2, the fastener 26 is used to secure rod supporting member 22 to arm 2 and to secure mounting clip 30 to rod supporting member 22 although separate fasteners may be used. Moreover mounting clip 30 or rod supporting member 22 may be provided with an integral fastener. Mounting clip 30 includes a first flange 30*a* that extends substantially perpendicular to the surface to which it is mounted and has a first through hole 32 formed therein. A second flange 30*b* is arranged at approximately a right angle to flange 30*a* and includes a second through hole 34. The second flange 30*b* extends to the interior space 23 of the rod supporting member 22. A rod centering member such as post 36 may be provided on flange 30*b* that extends into rod supporting member 22. Post 36 extends into an aperture formed along the longitudinal axis of rod 11 to center the rod on the rod supporting member 22. Fastener 26 is inserted through hole 32 of mounting clip 30 and is threadably connected to threaded hole 25 on rod supporting member 22. Rod supporting member 22 is provided with a notch 38 along the edge 39 thereof that faces the surface to which member 22 is secured in the inside mount installation. Notch 38 is dimensioned to receive the mounting clip 30 such that the edge 39 of rod supporting member 22 is flush with the surface to which the member 22 is mounted. The notch 38 may be omitted if a flush mount of the rod supporting member 22 to the surface is not desired. A fastener 40 such as a threaded screw may be inserted through hole 34 to attach mounting clip 30 to a surface. As best shown in FIG. 8, a projection 42 may be provided on the surface of the flange 30*b* that faces the surface to which the rod supporting member 22 is mounted. Projection 42 may include a sharp point or edge that can be pressed into the surface to prevent the rod supporting member from rotating about fastener 40 when member 22 is secured to the surface.

Figure 10:
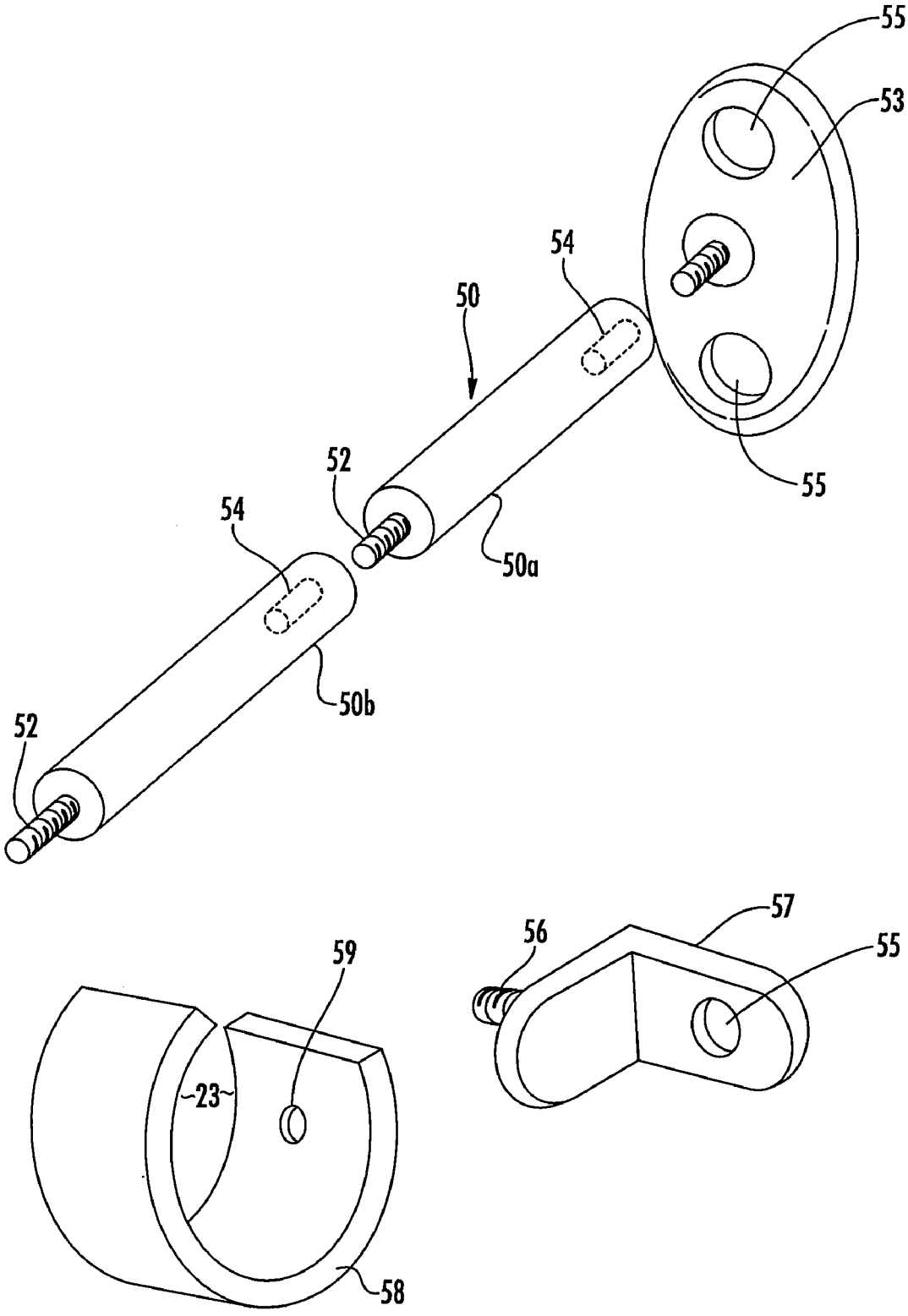

Referring to FIG. 7, to mount a rod 11 to a ring-shaped rod supporting member 22 for an inside mount, the mounting clip 30 is secured to the surface at the desired location. The rod 11 is inserted into ring 22. The ring 22 is then secured to the mounting clip 30 using fastener 26. The opposite end of the rod is mounted in the same manner. If the rod supporting member comprises a hook such as shown in FIG. 10, mounting of the hook could be done as previously described. Alternatively, the hook-shaped rod supporting member 58 could be secured to the mounting clip first and both of these elements could than be mounted to the surface. The rod 11 could then be inserted into the hook 58 after the mounting clip 30 and hook 58 are mounted to the surface.

Figure 9:
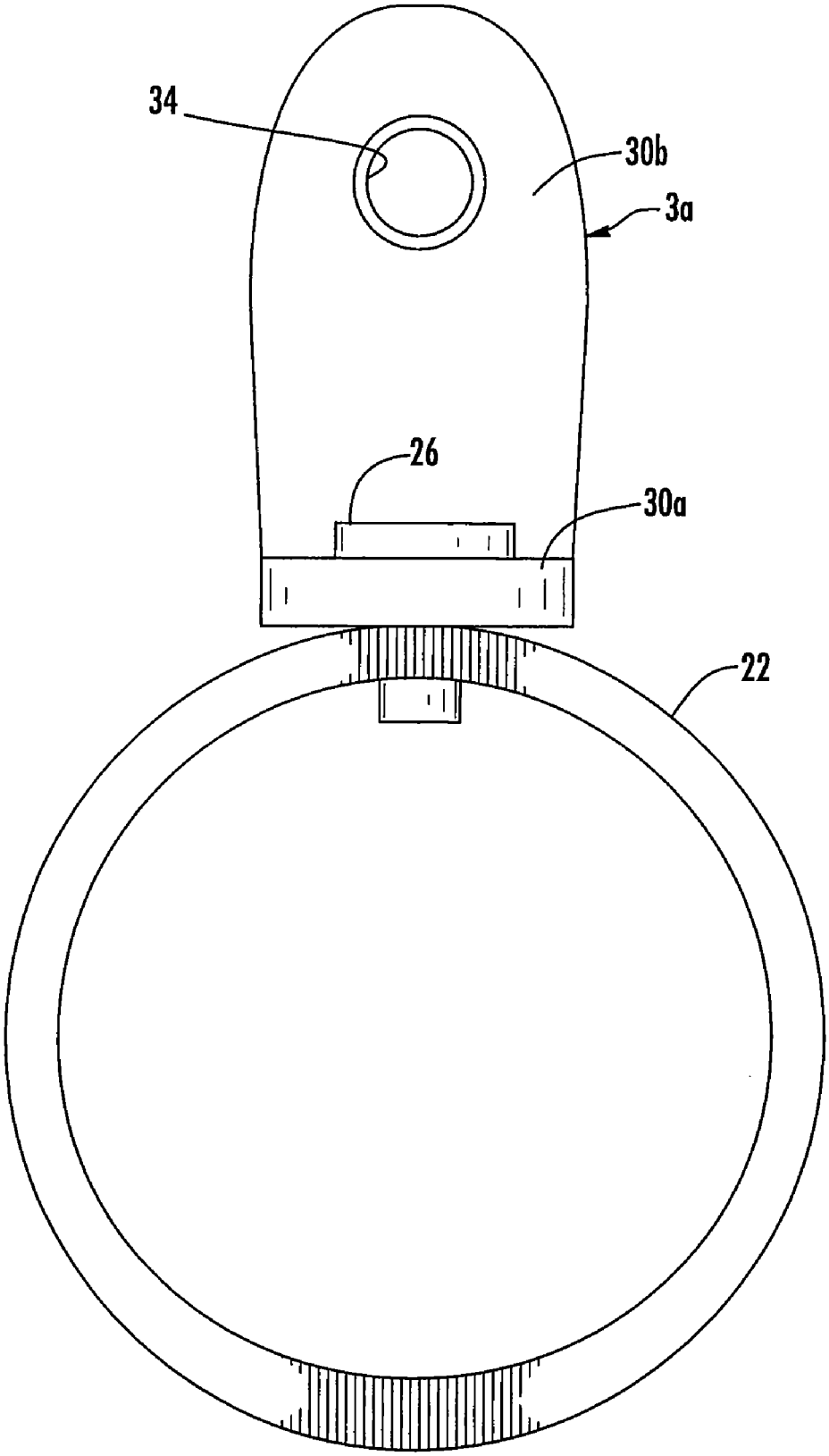
FIGS. 9 through 11 show alternate embodiments of the bracket of the invention.

An alternate embodiment of the mounting clip 30 and rod supporting member 22 is shown in FIG. 9 where the mounting clip 30 is secured such that flange 30*b* is arranged extending outside of rod supporting member 22 rather than into the interior space of rod supporting member 22. Rod centering member 36 may be eliminated.

Another embodiment of the invention is shown in FIG. 10 where the arm 50 is comprised of discrete segments 50*a* and 50*b* that can be connected to one another and to wall mount flange 53 to vary the effective length of the arm. While the illustrated embodiment discloses two arm segments, a greater or fewer number of segments may be used. Each arm segment and the wall mount flange include a threaded male member 52 that engages a threaded hole 54 of the adjacent segment. The final segment can be threaded to rod supporting member 58. In such an arrangement, an additional threaded member 56 is used to connect the mounting clip 57 to threaded hole 59 of rod supporting member 58. Threaded member 56 may be integral with the mounting clip 57 as shown or it may be a separate fastener as described with respect to the embodiment of FIGS. 1 through 4. In the illustrated embodiment the rod supporting member 58 is a hook that extends for a portion of the periphery of rod 11 such that it can support the rod in both the ceiling mount and wall mount installations. Mounting clip 57 and mounting flange 53 are provided with through holes 55 for receiving fasteners (not shown) for mounting the bracket to a surface.

Figure 11:
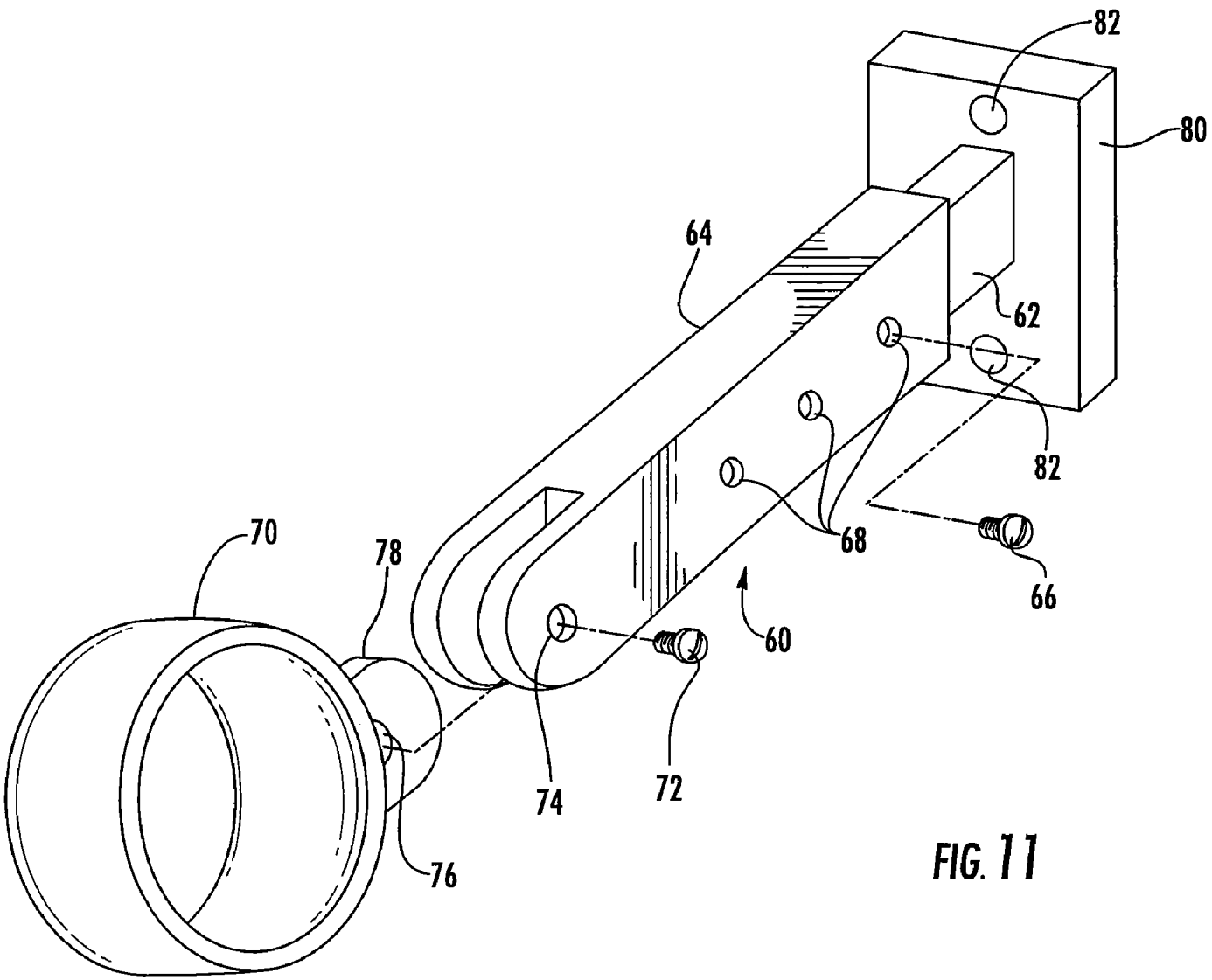

Another embodiment of the invention is shown in FIG. 11 where arm 60 includes a first segment 62 telescopically connected to a second segment 64. Segment 62 is connected to wall mount flange 80 that is provided with through holes 82 for receiving fasteners (not shown) for mounting the bracket to a surface. Segment 62 telescopically slides within a longitudinal channel formed in segment 64 and is maintained in position by a fastener 66 that is inserted through one of a plurality of aligned holes 68 and mechanically engages a threaded hole formed on member 62. The rod supporting member 70 is connected to arm 60 by a fastener 72 that is inserted through hole 74 formed on the arm 60 and mechanically engages threaded hole 76 formed on a flange 78 extending from the rod support element 70. For an inside mount, the rod supporting member 70 can be attached to the surface by a fastener engaging hole 76 such that a separate mounting clip need not be used.

While embodiments of the invention are disclosed herein, various changes and modifications can be made without departing from the spirit and scope of the invention. One of ordinary skill in the art will recognize that the invention has other applications in other environments. Many embodiments are possible. The following claims are in no way intended to limit the scope of the invention to the specific embodiments described above.

The invention claimed is:

1. A kit for mounting a rod comprising:

a rod supporting member comprising a ring defining an interior space for receiving a rod, said rod supporting member defining a first location on said ring;

an adjustable support arm comprising a first arm portion including a mounting flange formed on said first arm portion defining a first aperture for receiving a fastener for mounting said adjustable support arm to a first surface, said adjustable support arm including a second arm portion secured to said first location and movably mounted relative to said first arm portion such that a length of said adjustable support arm may be adjusted, a second fastener releasably securing said second arm portion to said rod supporting member at said first location; and a mounting clip comprising a first flange arranged at approximately a right angle relative to a second flange, the second fastener releasably securing said first flange to said rod supporting member at said first location such that said ring occupies a first orientation relative to said mounting clip where said second flange extends into the interior space of the ring or a second orientation where said second flange extends outside of said ring, and said second flange defining a second aperture for receiving a fastener for mounting the mounting clip to a second surface:

wherein in a first configuration said rod supporting member is connected to the adjustable support arm for connecting the rod supporting member to the first surface and in a second configuration said rod supporting member is connected to the mounting clip for connecting the rod supporting member to the second surface.

2. The apparatus of claim 1 wherein said rod supporting member includes a notch at the periphery thereof for receiving said mounting clip such that said rod supporting member is flush with said second surface.

3. The apparatus of claim 1 wherein said mounting clip includes a sharp protrusion formed integrally with said mounting clip for engaging said second surface.

4. The apparatus of claim 1 wherein said first arm portion and said second arm portion telescope.

5. The apparatus of claim 1 wherein said first arm portion and said second arm portion occupy one of a plurality of discrete positions relative to one another and wherein said first arm portion is fixed in one of said discrete positions relative to said second arm portion.

6. The apparatus of claim 1 wherein said second flange supports a post that extends into the interior space of the ring and is adapted to engage the rod.

* * * * *